United States Patent [19]

Collins

[11] 4,439,383

[45] Mar. 27, 1984

[54] METHOD OF CONSTRUCTING SHELL-FORMED STRUCTURES

[76] Inventor: Billy J. Collins, P.O. Box 1327, Claremore, Okla. 74017

[21] Appl. No.: 414,660

[22] Filed: Sep. 7, 1982

[51] Int. Cl.[3] ..... E04B 1/32

[52] U.S. Cl. ..... 264/32; 52/88; 249/184; 264/313

[58] Field of Search ..... 264/32, 313; 52/80, 52/86, 88; 249/153, 177, 183, 184

[56] References Cited

U.S. PATENT DOCUMENTS

| | | | |
|---|---|---|---|
| 2,820,990 | 1/1958 | Johnson | 52/80 |
| 3,562,975 | 2/1971 | Moss | 52/80 |
| 3,914,077 | 10/1975 | Lodes | 264/32 X |
| 4,149,351 | 4/1979 | Belt | 264/32 X |
| 4,372,733 | 2/1983 | Tinning | 264/32 |

*Primary Examiner*—Donald E. Czaja

*Assistant Examiner*—James C. Housel

*Attorney, Agent, or Firm*—Head, Johnson & Stevenson

[57] ABSTRACT

A method of constructing a shell-formed structure including the steps of first constructing a base, such as concrete slab, having a retention means defining the area of contact of the finished wall of the building with the base, the retention may be in the form of a recessed notch formed in the concrete pad, supporting a top yoke centrally above the base, positioning a plurality of spaced apart flexible slats between the base retention means and the yoke, lowering the yoke to cause the flexible slats to bow uniformly in a generally quarter circular or quarter elliptical configuration so that the bow slats generally define the exterior wall shape of the building, attaching a covering to the bowed slats, applying a layer of settable material, such as concrete, to the covering and allowing the settable material to harden to thereby form the structure.

6 Claims, 8 Drawing Figures

METHOD OF CONSTRUCTING SHELL-FORMED STRUCTURES

BRIEF SUMMARY OF THE INVENTION

A method is described for construction of shell-formed structures primarily of the circular base igloo type and the elongated semi-circular cross-sectioned type. A building is constructed according to the invention by first forming a base which is best achieved by pouring a concrete slab. Formed in the slab or attached to it is a base retention means defining the area where the completed building exterior wall will contact the base. This retention means can be effectively achieved by forming a recessed grove or slot in the concrete base. Another way is to attach a structural steel angle member to the concrete pad.

A top yoke member is then supported above the base. If the building is to be circular or igloo-shaped, the top yoke member will likewise be circular of relatively small diameter compared to that of the completed building base structure. If the building is to be of the elongated semi-circular cross-sectioned type, the top yoke structure is elongated and supported in a vertical plane which is centrally positioned of the base retention means.

Spaced apart flexible slats such as may be made of wood (hickory being an ideal type), plastic or fiberglass are positioned between the base retention means and the top yoke. When the building is of igloo configuration the slats taper towards each other at the top so that the top ends are in close proximity or perhaps in contact with each other whereas the lower ends of the slats are spaced apart from each other. Where the building is of the elongated semi-circular cross-sectioned type the slats are parallel to each other. Next, the top yoke is lowered to cause the slats to uniformly bow into a general quarter circular or quarter elliptical configuration generally defining the desired exterior configuration of the structure. To cause the top yoke to be lowered, an ideal method is to attach an anchor to the base vertically below the top yoke. A cable and winch are then connected between the anchor and the yoke. By winding the cable on the winch, the yoke can be pulled downwardly, uniformly deflecting the slats.

After the slats are deflected to the general shape of the desired building, a covering is attached to them. The covering may be attached in a variety of ways. One is by the use of individual panels configured to be attached to the slats at the edges of the panels. When the building is of igloo construction the panels are generally triangular. When the building is of elongated semi-circular cross-sectioned configuration the panels are rectangular. Another method is to cover the deflected slats with sheet material. A layer of settable material is then applied to the covering. This can best be accomplished by spraying material onto the form provided by the deflected slats and the covering. Plastic or other type of settable material may be used, however, an inexpensive material which accomplishes the purpose of the invention is achieved by the use of concrete.

After the concrete or other settable material is sprayed on the form and allowed to set or harden, the basic building shape is achieved. Forms may be applied to the basic construction prior to the spraying of the concrete to provide openings for doors, windows and the like.

After the settable material is hardened, the slats can be removed. This can be accomplished by releasing the cable holding the top yoke down. This will allow the top yoke to extend upwardly, forming an opening in the building which is the diameter of the yoke. Thereby the yoke and the slats may be removed for subsequent usage. After the slats are removed, the panels may then also be removed. The opening in the top of the building may then be patched or covered to thereby complete the building.

BRIEF DESCRIPTION OF THE VIEWS OF THE DRAWING

FIG. 1 shows scaffolding as used in temporarily supporting the upper yoke member and for use in placing the slats in position.

In FIG. 2 the slats are in position to receive a covering.

DETAILED DESCRIPTION

Figure 1:
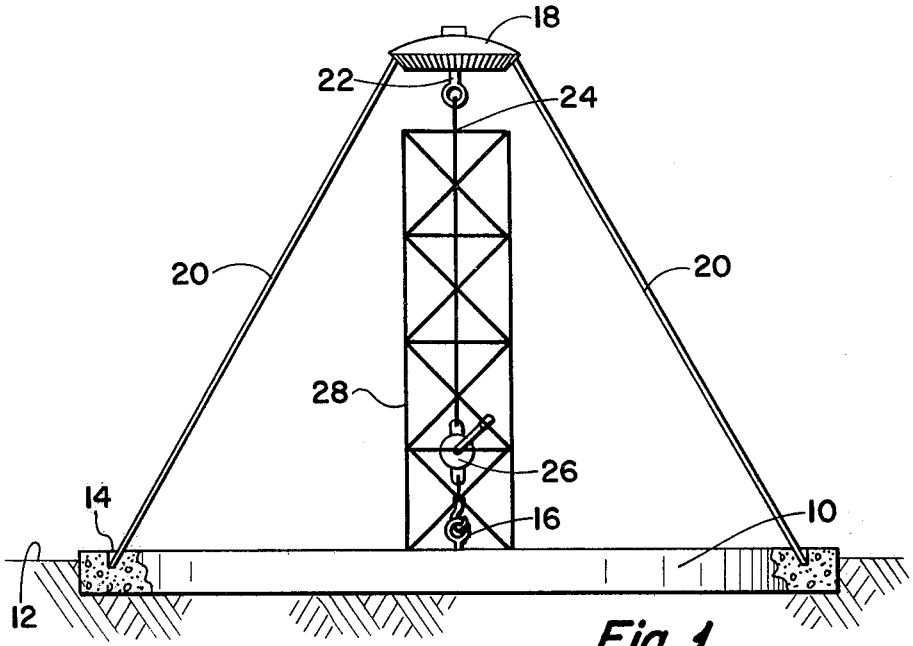
FIG. 1 is an elevational view of a base, shown partially in cross-section and showing a yoke member supported above the base and with slats extending from the base to the yoke member.

Referring to the drawings and first to FIGS. 1 and 2, a method of construction of the invention will be described.

The first step is to construct a base for the structure. This can be in the form of a concrete slab 10 poured on the earth's surface 12. The plan shape of the base 10 will be determined by the desired shape of the building. The base 10 must be at least and preferably somewhat larger than the shape of the building. For instance, if the building is to be of igloo configuration the base 10 may be round. However, of course, the base can be of any configuration larger than the desired building.

A retention means must be provided on the base 10 which defines the area of contact of the finished building wall with the base. One means of providing such retention means is to form a recess, groove, or slot 14 in the base. This can be easily achieved when the base is formed of concrete. Another way of providing the retention means is to employ a structural length of metal such as of L-shaped cross-sectional configuration in which one leg of the metal may be bolted to the top surface of the base 10.

Also secured to the base 10 is an anchor 16. Where the building is to be of igloo configuration, only a single anchor 16 is employed which is in the center of the building outline.

Positioned directly above the anchor 16 is a top yoke 18. Extending between the retention means or slots 14 and the top yoke 16 are a plurality of spaced apart flexible slats 20, only two of which are shown in FIGS. 1 and 2. The slats 20 are of flexible material such as wood, and the cross-sectional dimensions of the slats will be related to their length. The slats 20 may typically be of ¾ to 1" thick and 2 to 4" wide, although much thicker and wider slats may be employed if the lengths are great.

Affixed to the bottom of top yoke 18 is a hook 22. Extending between the anchor 16 and hook 22 is a cable 24 and a cable winch 26.

Figure 2:
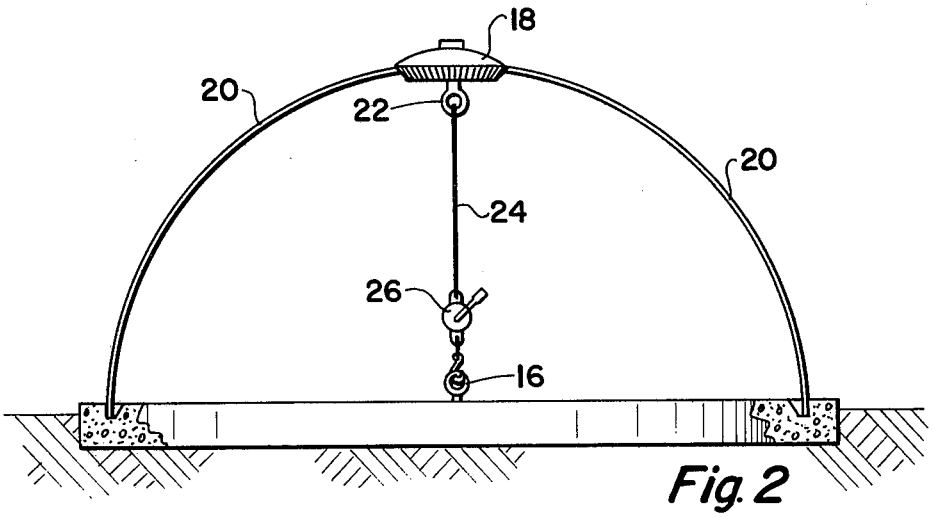
FIG. 2 shows the yoke member having been drawn downwardly to deflect the slats.

As shown in FIG. 1, in order to assist in assembling the slats 22 and the top yoke 18, a scaffolding 28 may be employed which is removed after all of the slats 20 are in position.

Figure 3:
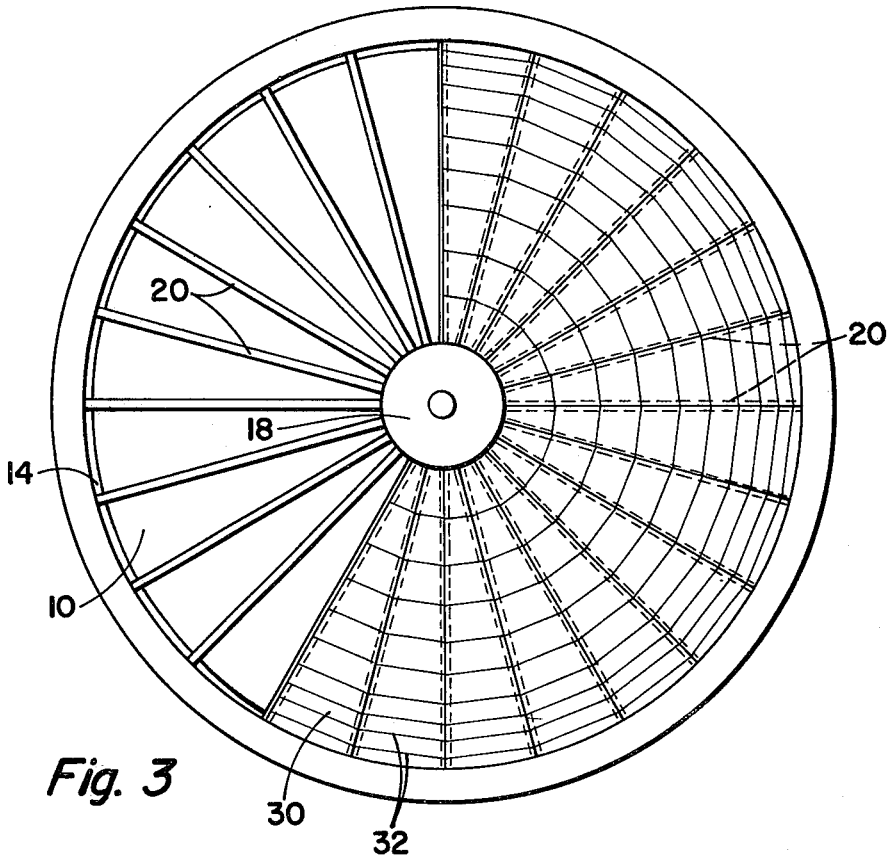
FIG. 3 is a plan view of a building under construction showing the slats having been bowed to a semi-circular or semi-elliptical configuration and with panels partially in place to form the outline of the exterior wall.

When the building is of a circular floor plan, that is, of an igloo configuration, the slats will be arranged between the pad and the top yoke 18 as shown in FIG. 3.

After all of the slats 20 are in position, the scafolding 28 is removed. Winch 26 may then be used to wind the cable 24 thereon, pulling the top yoke 18 downwardly. This causes the slats 20 to bend uniformly into a configuration so that each of the slats is a quarter-circular or quarter-elliptical configuration such as shown in FIG. 2. The cable 24 is drawn downwardly sufficiently to produce the desired exterior configuration of the building.

Figure 4:
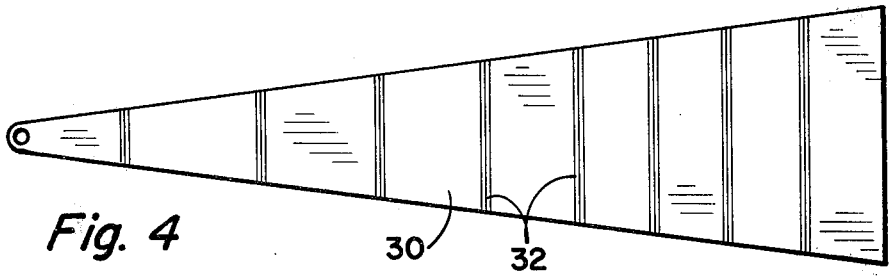
FIG. 4 is a plan view of a panel as may be employed to form the skin of the building form when the building is circular, or of the igloo type.
Figure 5:
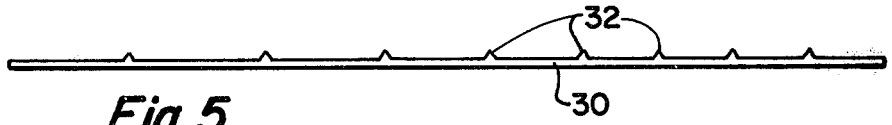
FIG. 5 is a side view of the panel of FIG. 4.

When the desired configuration is achieved a covering is applied to the slats. This may be in the form of a plurality of panels such as the triangular shaped panel 30 of FIG. 4. These panels are attached to adjacent slats 20 to provide an outer skin or covering over the slats. In the arrangement of the panels 30 of FIG. 4, they may be made of plastic with integral ribs 32 for reinforcing purposes. FIG. 3 shows a portion of the panels in place over the slats 20.

Another arrangement is to cover the slats 20, after they are deflected into the desired configuration, by a sheet of plastic material.

After the slats are in the desired configuration and the covering is provided, whether by use of panels or sheet material, the exterior of the building is sprayed with a settable material, such as plastic or, most preferably, concrete.

Figure 6:
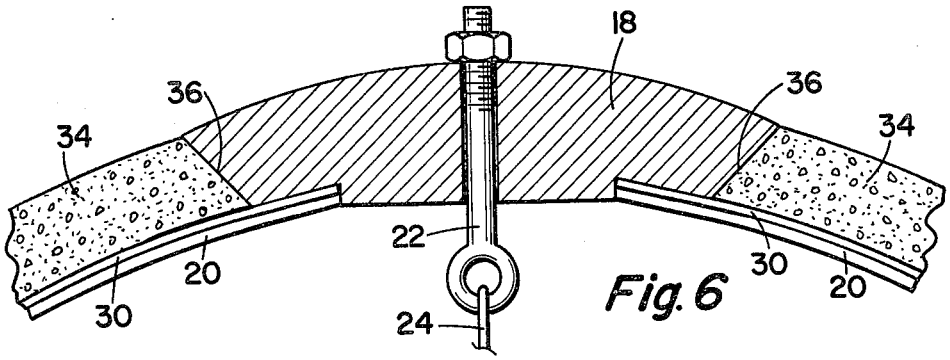
FIG. 6 is an enlarged detailed view of the upper yoke and the upper end of the slats and with a settable material, such as concrete, having been sprayed in place and hardened.
Figure 8:
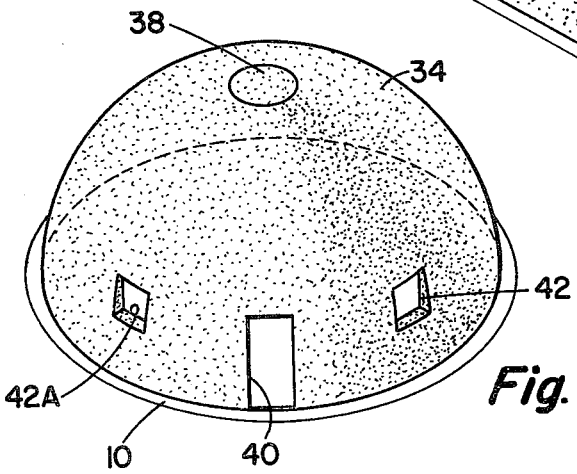
FIG. 8 is an isometric view of a completed shell-formed building using the methods of the present invention in which the building is of igloo shape, that is, with a circular base.

After the settable material is hardened or set, a building such as shown in FIG. 8 is obtained. This is an igloo configuration wherein the floor plan is circular and built on a circular pad 10. After the material has been sprayed onto the skin covered slats, the cross-sectional configuration of the upper portion of the building will appear as in FIG. 6. Panels 30 extending between slats are in engagement with the top yoke 18. The settable material or concrete 34 is sprayed to the desired thickness to give the finished building the structural strength needed with the material being preferably from 3 to 6" in thickness for the normal size building such as for residential use but with thicker construction where the building is large, such as for industrial, warehouse, or storage use.

After the spray-on material 34 is hardened, the upper yoke 18 may be removed by unwinding winch 26. This will form an opening 36 in the central upper portion of the building. As the cable 24 is loosened, the normal resiliency of the slats will cause them to straighten and extend upwardly through the opening 36. The slats and the panels 30 may then be removed for subsequent use. Paraffin or other type of material may be sprayed onto the exterior surfaces of the panels and slots before the concrete 34 is sprayed on so that the concrete does not adhere to the panels or the slats, enabling their reuse.

Figure 7:
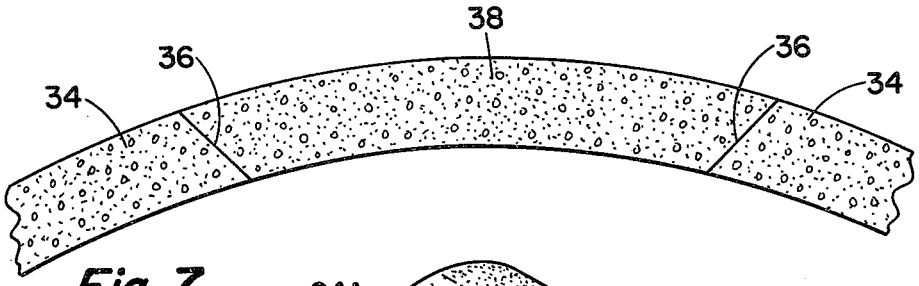
FIG. 7 is a view as in FIG. 6 with the yoke removed, with the slats removed, and with the opening formed by the removal of the yoke having been patched with settable material, such as concrete.

After the slats and panels have been removed, following removal of the top yoke, the opening 36 in the building may be patched with concrete 38 as shown in FIG. 7 to thereby complete the building.

FIG. 8 shows a completed building with provisions having been made for a door 40 and windows 42. These can be achieved by providing forms in the basic structure or these openings may be cut into the completed wall after the building is completed.

Figure 9:
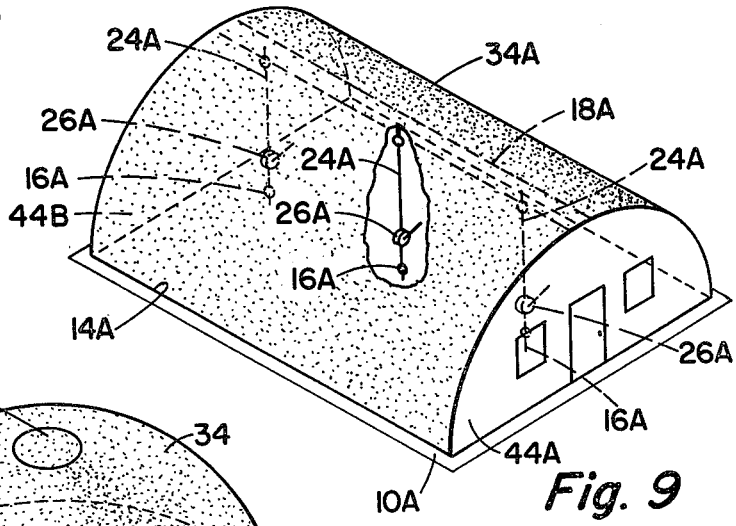
FIG. 9 is an isometric external view of a building having been formed by the methods of the present invention wherein the building is of elongated semi-circular cross-sectioned shape and showing how the cable and winches are employed to elevationally position the elongated upper yoke.

The type of building described with reference to FIGS. 1–8 is of the circular base or igloo configuration. The same principles of the invention may be employed to construct a building having a rectangular base, that is, the elongated semi-circular cross-sectioned configuration such as in FIG. 9. In using the invention for the construction of such a building, the base 10A can be rectangular. The top yoke 18A is elongated and formed in sections so that the total length of the sections is equal to the length of the desired building. The slots or retention means 14A which will hold the lower ends of the slats are parallel to the vertical plane of the elongated top yoke 18, and a plurality of cables 24A, winches 26A, and anchors 16A will be employed, depending on the total length of the building. When the slats are in place for a building of the configuration of FIG. 9 the panels (not shown), which can be rectangular, are positioned between the slats after which the settable material or concrete 34A is sprayed into position. Thus the total wall for the building of FIG. 9 can be sprayed on, after which the top yoke, slats and panels can be removed for reuse. The end walls 44A and 44B would then need to be constructed which can include the doors and windows as desired. The end walls are not formed as a part of the basic methods of the present invention but can be made of wood, metal, concrete block, brick, or any other typical construction techniques.

When the elongated semi-circular cross-sectioned walls are set (that is, if concrete is used, when it has hardened) the sections of the top yoke 18A are removed in a sequence rather than all at once. When some sections are removed the concrete patch 38 is installed and solidified before the other top yoke sections are removed. In addition, the yoke may be constructed in such a way that the slats can be removed individually from underneath the roof wall, so that no opening is formed in the roof wall when the yoke is removed.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

What is claimed:

1. A method of constructing a shell-form structure comprising:

constructing a base for such structure, the base having retention means defining an area of contact of the finished building wall with the base;

supporting a top yoke above the base;

positioning a plurality of spaced apart flexible slats, each with one end in engagement with the base retention means and an other end in engagement with said top yoke;

lowering said top yoke to cause said flexible slats to bow uniformly into a generally quarter-circular or quarter-elliptical configuration generally defining a desired exterior configuration of the structure;

attaching a covering to the bowed slats;

applying a covering layer of settable material to the covering;

allowing the settable material to set to thereby form a structure of the desired configuration.

2. The method of constructing a shell-form structure according to claim 1 wherein said step of lowering said top yoke to cause said flexible slats to bow includes:

affixing a cable to said top yoke;

affixing a cable winding means to an anchor positioned vertically below said top yoke; and winding said cable to draw said top yoke downwardly towards said anchor.

3. The method of constructing a shell-form structure according to claim 1 wherein said base is a pad of concrete and wherein said retention means is a recessed notch formed in said concrete pad.

4. The method of constructing a shell-form building according to claim 1 wherein said step of attaching a covering to the bowed slats includes attaching preformed panels between adjacent slats.

5. The method of constructing a shell-form building according to claim 1 wherein said top yoke is circular and wherein said base retention means is circular whereby the building has a generally semi-spherical configuration.

6. The method of constructing a shell-form building according to claim 1 wherein said top yoke is elongated and wherein said base retention means is in the form of spaced apart elongated linear means equally spaced from a vertical plane of said top yoke wherein said flexible slats are parallel to each other, whereby the building has a generally elongated semi-spherical cross-sectional configuration.

* * * * *